US007960004B2

(12) United States Patent
Yee et al.

(10) Patent No.: US 7,960,004 B2
(45) Date of Patent: Jun. 14, 2011

(54) GLUE-LAMINATED BAMBOO FURNITURE

(75) Inventors: Maria Yee, Santa Cruz, CA (US); Hua Xie, Guangzhou (CN)

(73) Assignee: Maria Yee, Inc., Scotts Valley, CA (US)

( * ) Notice: Subject to any disclaimer, the term of this patent is extended or adjusted under 35 U.S.C. 154(b) by 184 days.

(21) Appl. No.: 12/357,366

(22) Filed: Jan. 21, 2009

(65) Prior Publication Data

US 2009/0263610 A1 Oct. 22, 2009

(30) Foreign Application Priority Data

Apr. 17, 2008 (CN) ..... 2008 2 0112678 U

(51) Int. Cl.
*B32B 3/06* (2006.01)

(52) U.S. Cl. ..... 428/57; 428/60; 312/140.3

(58) Field of Classification Search ..... 428/57, 428/60; 312/140.3, 140.2; 52/782.2, 802.1, 52/782.21, 796.11, 796.12, 797.1
See application file for complete search history.

(56) References Cited

U.S. PATENT DOCUMENTS 6,286,577 B1 * 9/2001 Douglas et al. ..... 156/512
2009/0189494 A1 * 7/2009 Bendah ..... 312/140.3
* cited by examiner

*Primary Examiner* — Alexander Thomas
(74) *Attorney, Agent, or Firm* — Haynes & Boone, LLP.

(57) ABSTRACT

Glue-laminated bamboo furniture articles include a main panel (1) and plural panel supports (2). The panel (1) includes a main framework (11), a main plate (12) disposed on the main framework (11) and outer framework (13) covering the main framework (11). The main framework (11) is formed by joining corresponding ends of a plurality of frame borders (111). The main plate (12) corresponds in shape to a plane enclosed by the main framework (11) and includes slopes on interfacial edges (121) thereof. The outer framework (13) is formed by joining corresponding ends of sealing plates (131). Sloped upper ends (1311) of the sealing plates match the slopes on the interfacial edges (121) of the main plate (12). The resulting gluelam bamboo furniture has a trim aesthetic appearance, exhibits the beautiful natural texture of bamboo, effectively prevents the furniture from warping, has great durability, conserves materials and effectively reduces production costs.

8 Claims, 4 Drawing Sheets

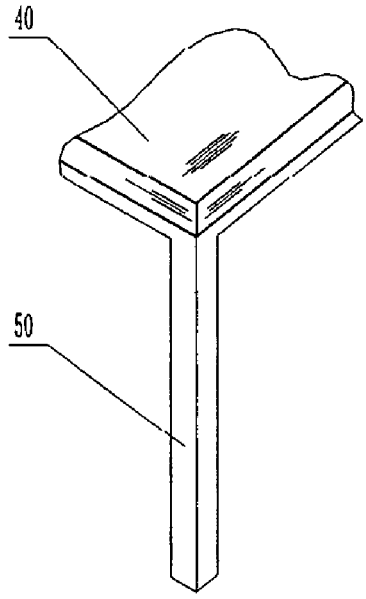
*Fig. 1 - Prior Art*
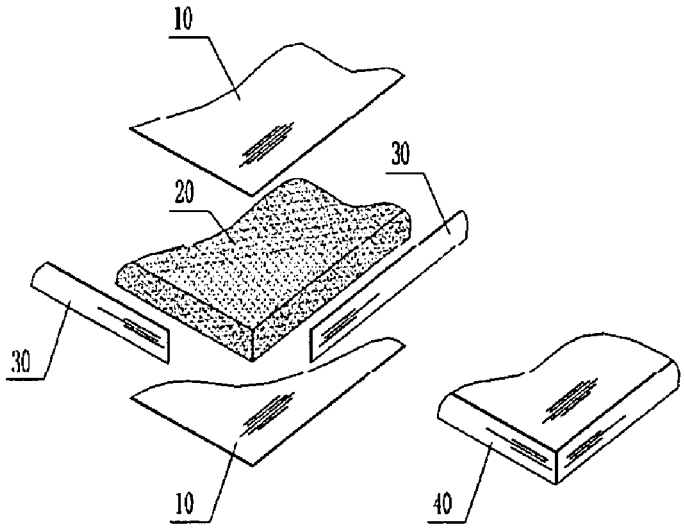
*Fig. 2 - Prior Art*

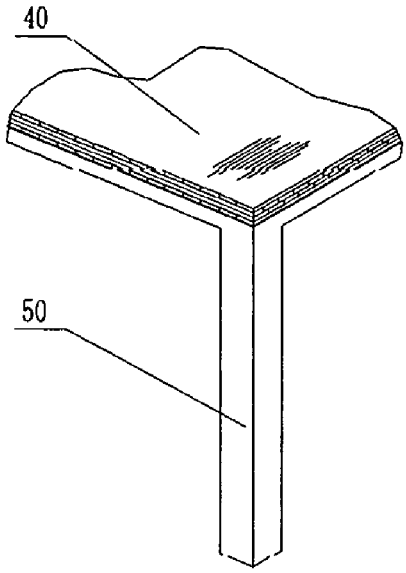
*Fig. 3 - Prior Art*
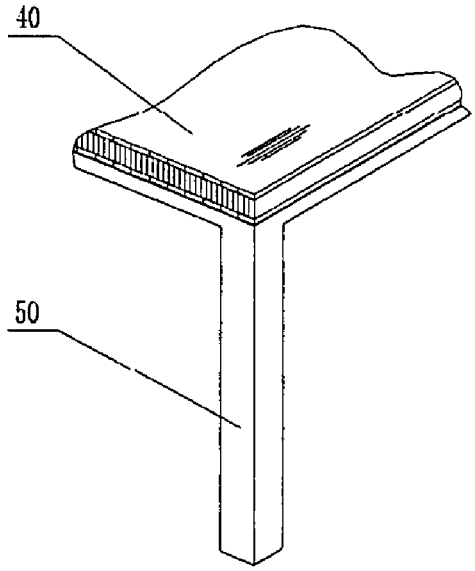
*Fig. 4 - Prior Art*

GLUE-LAMINATED BAMBOO FURNITURE

RELATED APPLICATIONS

This application claims priority of Chinese Patent Application No. 200820112678.9, filed Apr. 17, 2008, the entire disclosure of which is incorporated herein by reference.

BACKGROUND

1. Technical Field

The present invention relates to the manufacture of furniture in general, and in particular, to the manufacture of glue-laminated or "engineered" bamboo furniture in which the ends of bamboo board furniture components are hidden from view.

2. Related Art

Conventionally, bamboo furniture is made using wood or engineered bamboo boards or artificial "particle" boards (i.e., medium density compression-glued fiber or particle boards and the like) as substrates, to which thin decorative veneers, laminates and end sealing strips are then applied for cosmetic appearance. Since solid wood furniture consumes a relatively large amount of timber, the development of the furniture industry is constrained by the scarcity of available timber resources. The use of artificial boards in furniture therefore makes for a more efficient use of scarce timber resources. However, because more adhesive, and hence, more formaldehyde, is used in producing this type of furniture, this can also result in furniture that is not environmentally friendly, and in some cases, potentially harmful to human health.

Bamboo resources are currently very abundant in China. In the prior art, glue-laminated ("gluelam" or so-called "engineered bamboo") furniture typically incorporates one of two types of construction. As illustrated in FIGS. 1 and 2, the first type of furniture is made of artificial boards (e.g., medium density fiber or particle boards) used as substrates, to which bamboo veneers and edge strips having a thickness from about 0.3 mm to about 0.6 mm are applied.

The process for manufacturing furniture of this type is as follows. First, a bamboo veneer 10 is bonded on upper and lower surfaces of an artificial board substrate 20 with an adhesive. Then, the laminated substrate is pressed in a hot-press to cure the adhesive. After the adhesive is cured, the pressed laminated substrate is removed from the press and bamboo veneer strips 30 are bonded on the edges of the board 20 by an edge banding tool, thereby forming a finished panel 40. Finally, legs or panel supports 50 made of, e.g., steel or other materials, are then connected to the panel 40, thereby completing the desired article of furniture, e.g., a table. However, furniture panels 40 made in accordance with the foregoing process tend to warp easily in humidity and to produce unsightly bubbles on their surfaces, and further, the sealing strips on the edges of the panels are easily delaminated and stripped away from the panels, such that furniture incorporating such panels is not durable or practical.

As illustrated in FIGS. 3 and 4, the second type of furniture is made of panels of flat pressed glue-laminated bamboo boards or strips having a rectangular cross-section, in which the long dimension of the cross-section is disposed either horizontally (FIG. 3) or vertically (FIG. 4), with the same surface finish treatments as the particle board furniture panel 40 described above in connection with FIGS. 1 and 2. As illustrated in FIGS. 3 and 4, the article of furniture is finished by connecting supports 50 to the panel 40. This type of furniture not only consumes more timber materials, but as will be appreciated by reference to FIGS. 3 and 4, the ends of the bamboo boards of the panels 40 are exposed, which adversely impacts the aesthetic appearance of the furniture. Further, panels 40 made with this type of construction are weak in resisting deformation and warp easily in humidity, so that furniture incorporating such panels is not practical.

SUMMARY

In accordance with the present invention, articles of glue-laminated bamboo furniture are provided, including gluelam main panels therefor, that overcome the disadvantages of the prior art and produce furniture that has an a novel structure, an aesthetically pleasing appearance, good buckling and deformation resistance, and good practicality.

In one embodiment, an article of glue-laminated bamboo furniture, for example, a table, comprises a main panel having a plurality of main panel supports coupled thereto. The main panel includes a main framework, a main plate disposed on the main framework, and a outer framework covering lateral sides of the main plate and framework. The main framework is formed by joining corresponding ends of a plurality of frame borders to each other. The main plate corresponds in shape to a plane enclosed by the main framework and includes sloped interfacial edges. The outer framework is formed by joining corresponding ends of a plurality of sealing plates to each other in miter joints. The sealing plates have upper edges that are sloped to match the slope of the interfacial edges of the main plate and serve to hide the exposed ends of the bamboo boards of the furniture.

A better understanding of the above and many other features and advantages of the novel furniture articles of the present invention and the methods for making them may be obtained from a consideration of the detailed description of some example embodiments thereof below, particularly if such consideration is made in conjunction with the appended drawings, wherein like reference numerals are used to identify like elements illustrated in one or more of the figures thereof.

BRIEF DESCRIPTION OF THE DRAWINGS

FIG. 1 is a partial perspective view of an article of furniture incorporating a particle board main panel with a bamboo veneer applied over its outer surface in accordance with the prior art;

FIG. 2 is a partial exploded perspective view of the main panel of the furniture article of FIG. 1;

FIG. 3 is a partial perspective view of an article of furniture incorporating a main panel comprising layers of laminated, horizontally disposed flat bamboo boards having a bamboo veneer applied over its outer surface in accordance with the prior art;

FIG. 4 is a partial perspective view of an article of furniture incorporating a main panel comprising layers of laminated, vertically disposed flat bamboo boards having a bamboo veneer applied over its outer surface in accordance with the prior art;

DETAILED DESCRIPTION

The gluelam bamboo furniture articles of the present invention are described in detail below in the context of a table as an example embodiment. However, it should be understood that the construction techniques described herein can also be applied to many other types of furniture articles, e.g., chairs, benches, armoires, and the like.

Figure 5:
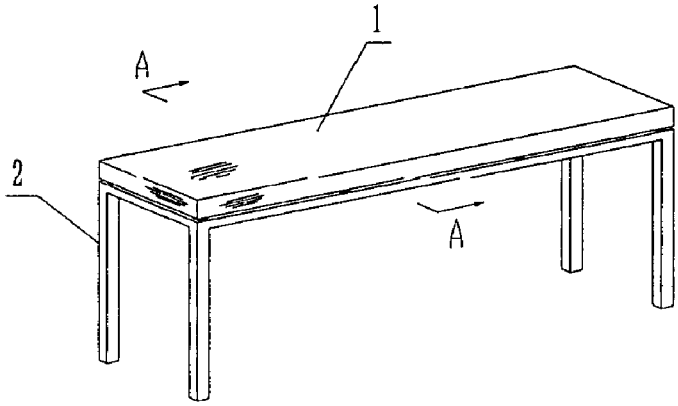
FIG. 5 is a perspective view of an example embodiment of an article of glue-laminated bamboo furniture in accordance with the present invention.
Figure 7:
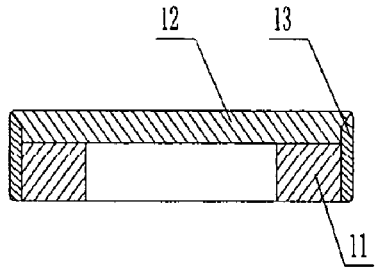
FIG. 7 is a cross-sectional view of the main plate of FIG. 6, as seen along the lines of the section A-A taken in FIG. 5.
Figure 9:
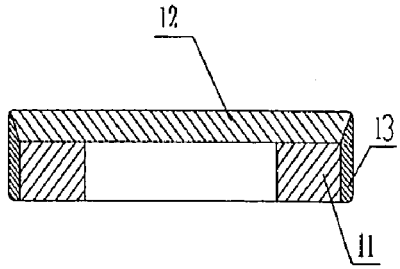
FIG. 9 is a cross-sectional view of the alternative main plate of FIG. 8, as seen along the lines of the section A-A taken in FIG. 5.
Figure 10:
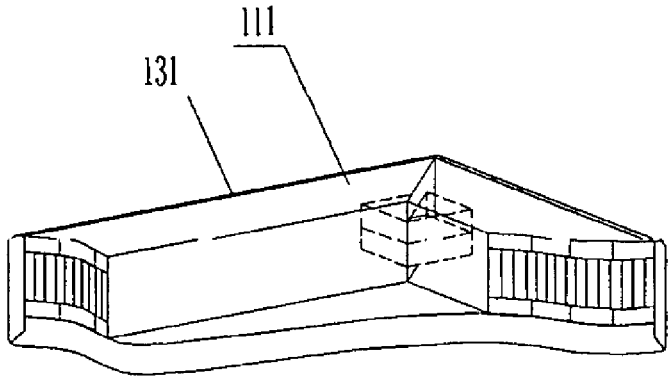
FIG. 10 is a partial cross-sectional perspective view of an exemplary embodiment of a main panel of an article of glue-laminated bamboo furniture in accordance with the present invention; and, FIG. 11 is a partial cross-sectional exploded perspective view of the example panel of FIG. 10.
Figure 11:
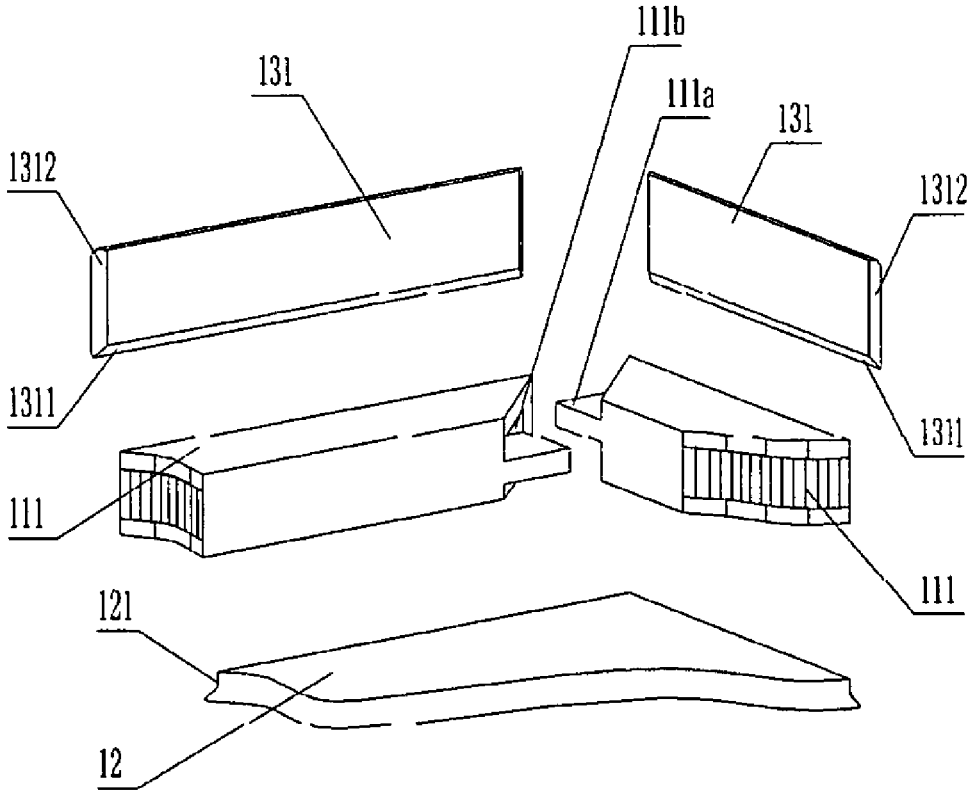

An example embodiment of an article of gluelam bamboo furniture, viz., a table, in accordance with the present disclosure is illustrated in the perspective view of FIG. 5. Referring to FIGS. 5, 9, 10 and 11, the table comprises a main panel 1 having a plurality of legs or supports 2 connected thereto. With reference to FIGS. 7 and 9, the main panel 1 comprises a main framework 11, a main plate 12 disposed at the top of the main framework 11, and an outer framework 13 covering the lateral sides of the main framework 11. With reference to FIGS. 10 and 11, the main framework 11 comprises a rectangular frame that is formed by bonding four frame borders 111 together at corresponding corners that are mitered at 45 degrees with an adhesive. In one advantageous embodiment, the corresponding mitered corners are joined by complementary tenons 111*a* and mortises 111*b* set in the frame borders 111.

Figure 6:
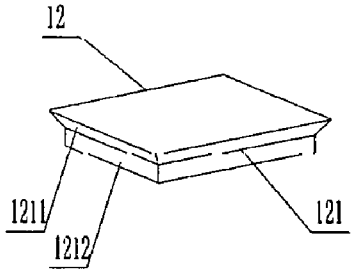
FIG. 6 is a perspective view of an embodiment of a main plate of the example furniture article of FIG. 5.

The main plate 12 defines a rectangular plane that corresponds to the rectangular plane enclosed by the main framework 11, and extends out to interfacial edges 121 that are mitered at 45 degrees. Referring to FIGS. 6 and 7, in one possible embodiment, the main plate 12 has a "⊽" shaped cross-sectional structure, in which the interfacial edges 121 have an upper portion 1211 that is sloped at 45 degrees. As illustrated in FIGS. 10 and 11, the upper end 1311 of an associated sealing plate 131 is correspondingly sloped at 45 degrees so as to match the upper slope 1211 of the upper interfacial edges 121 of the main plate 12. As illustrated in FIGS. 6 and 7, the interfacial edges 121 of the main plate 12 have a lower portion 1212 that is substantially vertical, and which corresponds to a vertical inner surface of the sealing plate 131. During assembly of the main panel 1, the upper end 1311 and inner surface of the sealing plate 131 and the upper and lower portions 1211 and 1212 of the interfacial edge 121 of the main plate 12 are respectively bonded to each other by an environmentally friendly adhesive.

The rectangular outer framework 13 of the table is formed by connecting four sealing plates 131 at corresponding corners. As illustrated in FIG. 11, both ends 1312 of each of the sealing plates 131 is sloped at 45 degrees, and is joined with the sloped end 1312 of an adjacent sealing plate 131 at a mitered joint that is bonded with an environmentally friendly adhesive.

In one example embodiment, the thickness of the main plate (12) is from about 10 mm to about 15 mm, and the thickness of the sealing plate (131) is from about 5 mm to about 8 mm. The relatively thin sealing plates 131 ensure that the end portions of the engineered bamboo boards of the main panel 1 are completely hidden from view, thereby providing the panel with a novel and more pleasing aesthetic appearance as compared to the exposed board ends of the prior art panels of FIGS. 3 and 4. As described above, the panel 1 has a frame-type structure and the lateral sides of the main framework 11 are covered by the outer framework 13, so the strength and distortion resistance of the panel is substantially enhanced, thereby effectively preventing the glued-laminated bamboo furniture from warping and resulting in furniture with good durability. Meanwhile, the main panel 1 incorporates components that are all made of relatively thin boards, thereby consuming less materials compared with prior art furniture that uses thick boards as panels and reducing production costs effectively.

Figure 8:
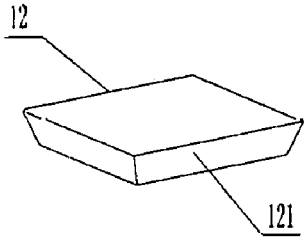
FIG. 8 is a perspective view of an alternative embodiment of a main plate of the example furniture article of FIG. 5.

An alternative embodiment of a main plate 12 that can be used in the table of FIG. 5 is illustrated in FIGS. 8 and 9. The structure of second embodiment is basically the same with that of the first embodiment described above, but with the following differences. Referring to FIGS. 8 and 9, the main plate 12 has a "⊔" shaped cross-section. The entire sides or interfacial edges 121 of the alternative main plate 12 are sloped at an angle, which may be at 45 degrees or another angle, and extend upwardly from the outer edge of the corresponding frame border 111. The interfacial edges 121 are bonded to complementary slopes at the upper ends 1311 of corresponding ones of the sealing plates 131 to form a right-angled miter joint, as illustrated in FIG. 9, and as in the first embodiment above, the ends of the bamboo boards of the main panel 1 are thereby completely hidden from view.

It should be understood that, in the present invention, the main panel 1 of the furniture article is not limited to rectangular shapes, and that main panels having other shapes, such as squares, equilateral polygons, triangles, circles and ellipses can also be connected using the above techniques. For an equilateral polygonal, the slope angle $\alpha$ at both ends of the sealing plates 131 forming the outer framework is given by the formula: $\alpha=90-180/n$, wherein n is a integer number equal to or greater than 3. This will ensure that the ends of the sealing plates 131 are hidden after adjacent sealing plates are joined to each other in the miter joint. Furthermore, the end portions of the bamboo boards of the main panel 1 are hidden after the upper slopes of the sealing plates 131 and the side interfacial edges 121 of the main plate 13 are joined with each other to provide the furniture with a finished, aesthetic appearance.

The furniture articles of the present invention provide several advantages over the prior art furniture:

- In the present invention, the ends of the glue-laminated bamboo boards of the furniture are hidden, thereby providing a more aesthetic appearance and revealing the beautiful natural texture of the bamboo timber.
- The main panels of the articles of the present invention have a frame-type structure, specially a main framework formed by frame borders that is covered by the outer framework, so the strength of the panel and its resistance to distortion is enhanced greatly, which effectively prevents the glue-laminated bamboo furniture from warping and results in furniture of great durability and practicability.
- Because the main panels of the present invention have a frame-type structure, furniture incorporating such panels consumes less materials compared to prior furniture using thick boards as panels, thereby effectively reducing production costs.

By now, those of skill in this art will appreciate that many modifications, substitutions and variations can be made in and to the materials, apparatus, configurations and methods of the novel gluelam bamboo furniture articles of the present disclosure without departing from its scope. Accordingly, the scope of the present disclosure should not be limited to the particular embodiments illustrated and described herein, as they are merely by way of some examples thereof, but rather, should be fully commensurate with that of the claims appended hereafter and their functional equivalents.

What is claimed is:

1. An article of glue-laminated bamboo furniture, comprising a main panel (1) having a plurality of main panel supports (2) coupled thereto, wherein:

the main panel (1) includes:

a main framework (11);

a main plate (12) disposed on the main framework (11), the main plate (12) having a "▽" cross-sectional shape; and, an outer framework (13) covering lateral sides of the main framework (11) and the main plate (12);

the main framework (11) is formed by joining corresponding ends of a plurality of frame borders (111) to each other, the main plate (12) corresponds to a plane enclosed by the main framework (11) and includes interfacial edges (121);

the interfacial edges (121) of the main plate (12) have a partially sloped structure with an upper portion (1211) sloped at 45 degrees and a lower portion (1212) that is substantially vertical;

the outer framework (13) is formed by joining corresponding ends of a plurality of sealing plates (131) to each other; and, the sealing plates (131) have an upper end (1311) that is sloped at 45 degrees to match the slope of the upper portions (1211) of the interfacial edges (121) of the main plate (12) and a lower inner surface that is substantially vertical to match the lower portions (1212) of the interfacial edges (121) of the main plate (12).

2. The furniture article of claim 1, wherein opposite ends (1312) of the sealing plates (131) forming the outer framework (13) are sloped and hidden after being joined in miter joints with corresponding ends of adjacent sealing plates (131).

3. The furniture article of claim 1 or 2, wherein:

the main framework (11) comprises a rectangular frame formed by joining corresponding ends of four frame borders (111) to each other;

the main plate (12) is rectangular in shape; and, the outer framework (13) comprises four sealing plates (131) defining a rectangular outer frame.

4. The furniture article of claim 3, wherein opposite ends (1312) of each sealing plate (131) are sloped at 45 degrees and are joined with corresponding ends of adjacent sealing plates (131).

5. The furniture article of claim 4, wherein the rectangular framework (11) is formed by joining corresponding ends of adjacent frame borders (111) to each other with mortise (111*b*) and tenon (111*a*) joints.

6. The furniture article of claim 1, wherein the shape of the main plate (12) corresponds to an equilateral polygon, a circle or an ellipse, and wherein the respective shapes of the outer framework (13) and the main framework (11) correspond to the shape of the main plate (12).

7. The furniture article of claim 1, wherein the main plate (12), the main framework (11) and the sealing plates (131) are bonded together with an adhesive.

8. The furniture article of claim 1, wherein the thickness of the main plate (12) is from about 10 mm to about 15 mm and the thickness of the sealing plates (131) is from about 5 mm to about 8 mm.

* * * * *